US010263361B1

(12) United States Patent
Gretz

(10) Patent No.: US 10,263,361 B1
(45) Date of Patent: Apr. 16, 2019

(54) TRANSITION FITTING FOR PHOTOVOLTAIC INSTALLATIONS

(71) Applicant: Arlington Industries, Inc., Scranton, PA (US)

(72) Inventor: Thomas J. Gretz, Delray Beach, FL (US)

( * ) Notice: Subject to any disclaimer, the term of this patent is extended or adjusted under 35 U.S.C. 154(b) by 0 days.

(21) Appl. No.: 15/850,277

(22) Filed: Dec. 21, 2017

Related U.S. Application Data

(60) Provisional application No. 62/438,710, filed on Dec. 23, 2016.

(51) Int. Cl.

| | |
|---|---|
| ***H01R 4/60*** | (2006.01) |
| ***H01R 13/52*** | (2006.01) |
| ***H01R 13/59*** | (2006.01) |
| *H01R 13/648* | (2006.01) |
| *H01R 4/64* | (2006.01) |
| *H01R 4/66* | (2006.01) |
| *H01R 4/36* | (2006.01) |

(52) U.S. Cl.
CPC ..... *H01R 13/5205* (2013.01); *H01R 13/59* (2013.01); *H01R 4/36* (2013.01); *H01R 4/60* (2013.01); *H01R 4/643* (2013.01); *H01R 4/66* (2013.01); *H01R 13/648* (2013.01)

(58) Field of Classification Search
CPC ..... H01R 13/648; H01R 4/60; H01R 4/643; H01R 4/66; H01R 4/36
See application file for complete search history.

(56) References Cited

U.S. PATENT DOCUMENTS

| | | | | |
|---|---|---|---|---|
| 5,072,072 | A | 12/1991 | Bawa et al. | |
| 5,929,383 | A * | 7/1999 | Marik | H02G 15/04 174/78 |
| 6,670,553 | B1 | 12/2003 | Gretz | |
| 6,765,143 | B2 | 7/2004 | Kiely | |
| 6,988,746 | B2 | 1/2006 | Olson | |
| 7,080,859 | B1 | 7/2006 | Gretz | |
| 7,374,212 | B1 | 5/2008 | Gretz | |
| 7,390,027 | B2 | 6/2008 | Kiely | |
| 7,841,630 | B1 | 11/2010 | Auray et al. | |
| 7,976,070 | B2 | 7/2011 | Kiely | |
| 8,474,877 | B2 | 7/2013 | Smith | |
| 8,563,876 | B1 * | 10/2013 | Gretz | H01R 13/59 174/541 |
| 8,979,557 | B2 * | 3/2015 | Dinh | H02G 3/0691 439/100 |
| 9,252,577 | B1 | 2/2016 | Smith | |

(Continued)

*Primary Examiner* — Tho D Ta

(57) ABSTRACT

A transition fitting for achieving a rain-tight transition at the entry of photovoltaic cables with EMT. The transition fitting includes a fitting body with an internal bore, a grommet seated within the bore, a nut for tightening the grommet against the fitting body, a compression fitting and a ground lug extending from the nut. A plurality of bores extend partially through the grommet. Photovoltaic (PV) cables may be inserted within one or more of the bores in the grommet and the nut tightened upon the fitting body to form a rain-tight fit around the PV cables. The skins of the grommet remain intact in any unused bores to maintain a rain-tight seal on any unused bores. The transition fitting will maintain a rain-tight seal at the entry of PV cables to EMT. The ground lug provides a means of grounding the EMT to the transition fitting.

9 Claims, 6 Drawing Sheets

(56) References Cited

U.S. PATENT DOCUMENTS

| | | | | |
|---|---|---|---|---|
| 9,341,292 | B2 | 5/2016 | Smith et al. | |
| 9,385,520 | B1 | 7/2016 | Gretz | |
| 9,490,619 | B2 | 11/2016 | Smith | |
| 10,027,039 | B1 * | 7/2018 | Smith | H01R 4/66 |
| 2005/0194785 | A1 * | 9/2005 | Shemtov | F16L 19/0212 285/382.7 |

* cited by examiner

TRANSITION FITTING FOR PHOTOVOLTAIC INSTALLATIONS

This application claims the benefit of provisional U.S. Application No. 62/438,710, filed Dec. 23, 2016.

FIELD OF THE INVENTION

This invention relates to the wiring of electrical cables and more specifically to an electrical fitting for establishing a rain-tight connection between one or more photovoltaic cables and electrical metal tubing (EMT).

BACKGROUND

In a solar power system, photovoltaic cables typically carry DC power from solar panels to a DC to AC inverter, after which the AC power is typically routed to a fuse box. Solar power systems typically contain a number of solar panels, thus necessitating the routing of a plurality of photovoltaic (PV) cables or wires between the individual solar panels and the inverter. In order to better protect the photovoltaic cables from rain and UV light, the photovoltaic cables are frequently routed through electrical metal tubing (EMT).

Unfortunately, in conventional routings of PV cables to EMT, the entry of the PV cables into the EMT is typically left open to the elements, such as rain, or is alternatively sealed with electrical sealant materials. The use of sealant creates an unsightly connection between the PV cables and the EMT and, if not properly installed by the electrician, can lead to an ineffective seal between the PV cables and the EMT.

Accordingly, what is needed is an appropriate transition fitting that enables a rain-tight connection of PV cables to EMT without the use of electrical sealants.

BRIEF SUMMARY OF THE INVENTION

The current invention is a transition fitting for achieving a rain-tight connection at the entry of photovoltaic cables into EMT. The transition fitting includes a fitting body, a grommet, a nut with a ground lug, and a compression fitting. The fitting body and grommet each include a leading end, a trailing end, and a bore there through. A plurality of bores extend from the trailing end and partially through the grommet. A skin closes off each bore at the leading end of the grommet. The nut includes internal threads that mate with external threads on the fitting body. External facets on the trailing end of the grommet mate with internal facets in the bore of the fitting body, thereby enabling the trailing end of the grommet to lock into the bore of the fitting body with tightening of the nut onto the fitting body. Photovoltaic (PV) cables may be inserted within one or more of the bores in the grommet and the nut tightened upon the fitting body thereby compressing the grommet and forming a rain-tight fit around each of the PV cables. The skins of the grommet are not broken in any unused bores, thereby maintaining a rain-tight seal on any unused bores. The trailing end of the fitting body includes a socket therein that will mate with an end of electrical metal tubing (EMT). The transition fitting will maintain a rain-tight seal at the entry of PV cables to EMT.

OBJECTS AND ADVANTAGES

A first object of the current invention is to provide a means of connecting PV cables to EMT in a rain-tight fit.

A second object of the current invention is to provide a rain-tight fit between PV cables and EMT without the use of electrical sealants.

A further object of the invention is to provide a transition fitting that enables a means of connecting PV cables to EMT.

A further object of the invention is to provide a transition fitting that will accommodate one or more PV cables and enable their connection to EMT.

These and other objects and advantages of the present invention will be better understood by reading the following description along with reference to the drawings.

BRIEF DESCRIPTION OF THE SEVERAL VIEWS OF THE DRAWING(S)

Reference is made herein to the accompanying drawings, which are not necessarily drawn to scale, and wherein.

DETAILED DESCRIPTION

Figure 1:
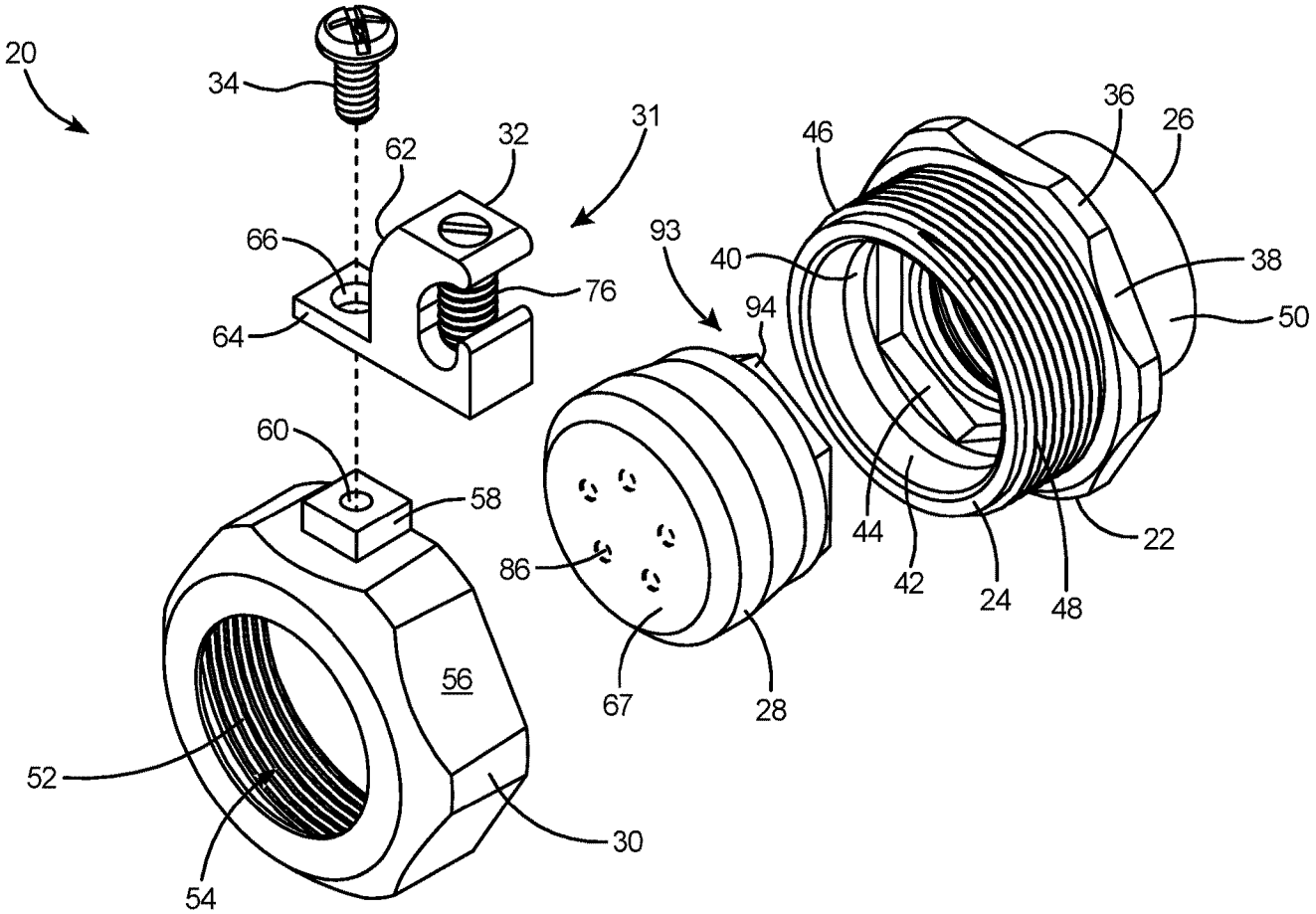
FIG. 1 is an exploded isometric view of a transition fitting assembly for photovoltaic installations in accordance with embodiments of the invention.

With reference to FIG. 1, the present invention is transition fitting 20 for connecting EMT to photovoltaic wires. The transition fitting 20 includes a tubular fitting body 22 having a leading end 24 and a trailing end 26, a grommet 28 for accepting photovoltaic wires, a nut 30, a grounding means 31 including a ground lug 32, and a fastener 34.

The fitting body 22 includes a flange 36 with external facets 38 thereon. The fitting body includes a bore 40 with a circular inner periphery 42 near the leading end 24 and internal facets 44 interior of the circular inner periphery. Fitting body 22 includes a leading end portion 46 with exterior threads 48 extending from the flange 36 to the leading end 24 and a trailing end portion 50 extending from the flange 36 to the trailing end 26.

Nut 30 is substantially tubular and includes an inner bore 52 with threads 54 thereon. Facets 56 are provided on the outer periphery of the nut. A post 58 extends from a facet 56 on the nut 30 and includes a bore 60 therein. The grounding means 31 provides a means of grounding the wires to the EMT and to the fitting body. Ground lug 32 is secured to the nut 30 by fastener 34 driven into bore 60 of post 58. Ground lug 32 includes a lug body 62, a leg 64 extending from the lug body, and an aperture 66 in the leg adapted to accept fastener 34. Grommet 28 includes a leading face 67, a trailing end 85, and a plurality of bores or apertures 68 extending into the grommet from the trailing end 85.

Figure 2:
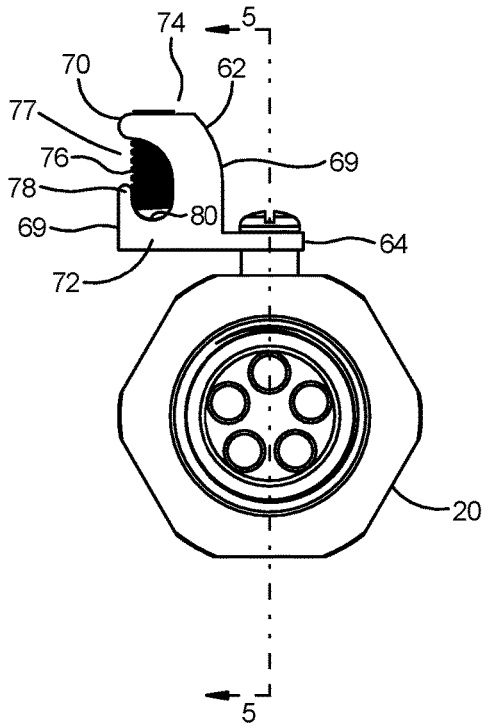
FIG. 2 is an end view from the right side of the transition fitting assembly of FIG. 1.
Figure 3:
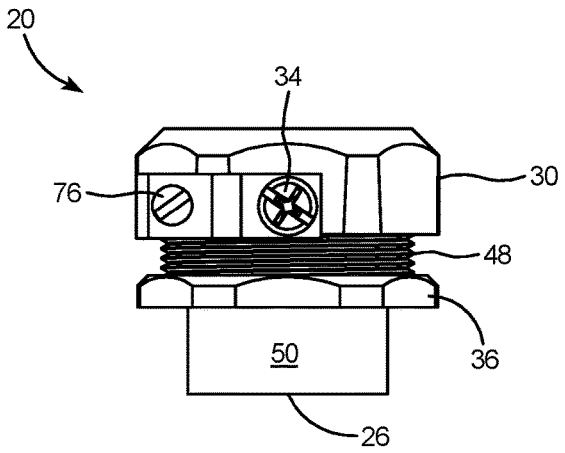
FIG. 3 is a top view of the transition fitting assembly.
Figure 4:
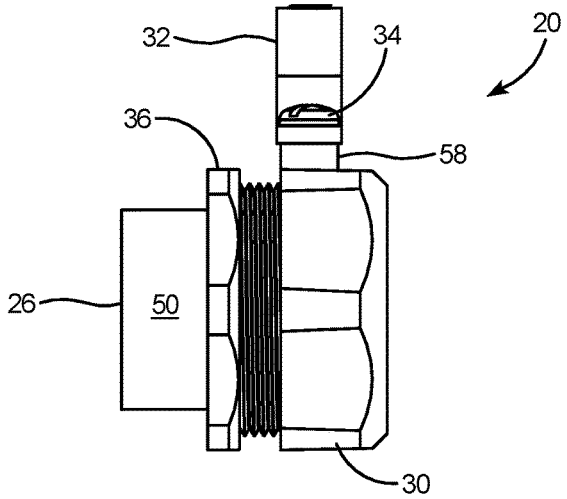
FIG. 4 is a side view of the transition fitting assembly.

Referring to FIG. 2, lug body 62 includes two sides 69 and a top arm 70 and bottom arm 72 extending from the side opposite the leg 64. The top arm 70 includes an aperture 74 therein adapted to accept threaded engagement of a grounding screw 76. A channel 77 is formed between the lug body 62, the top arm 70, the bottom arm 72, and the grounding screw 76. Bottom arm 72 includes an extension 78 that combines with the top surface of the bottom arm 72 to provide an arcuate surface 80 that is capable of accepting a grounding wire (not shown) for grounding the transition fitting 20.

Figure 5:
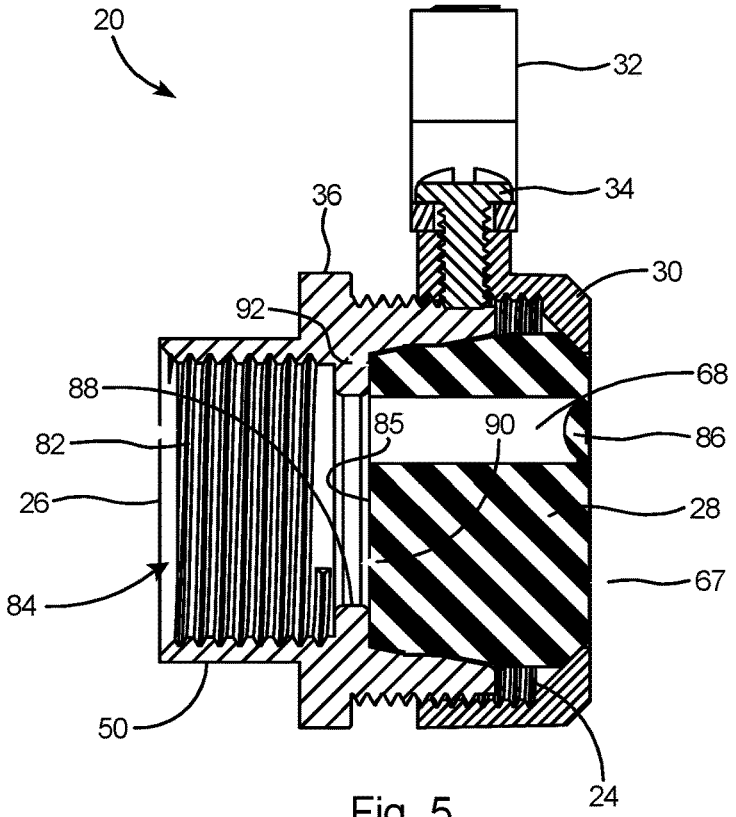
FIG. 5 is a sectional view of the transition fitting taken along line 5-5 of FIG. 2.
Figure 6:
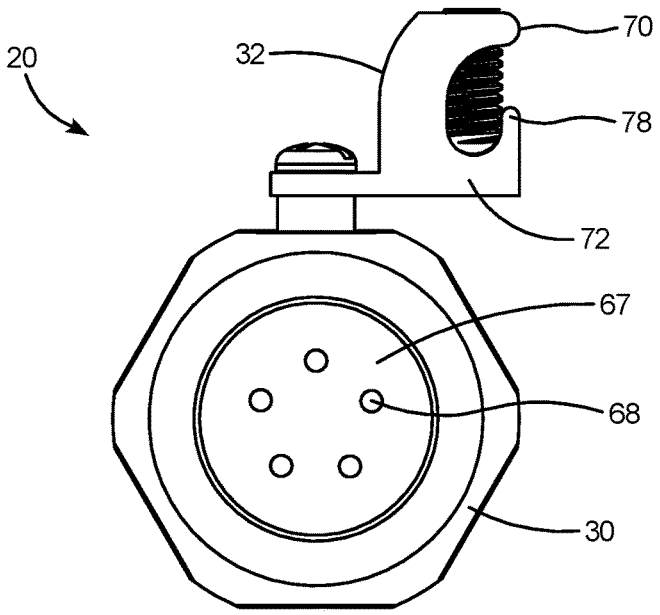
FIG. 6 is an end view of the transition fitting assembly from the left side of the transition fitting assembly of FIG. 1.
Figure 7:
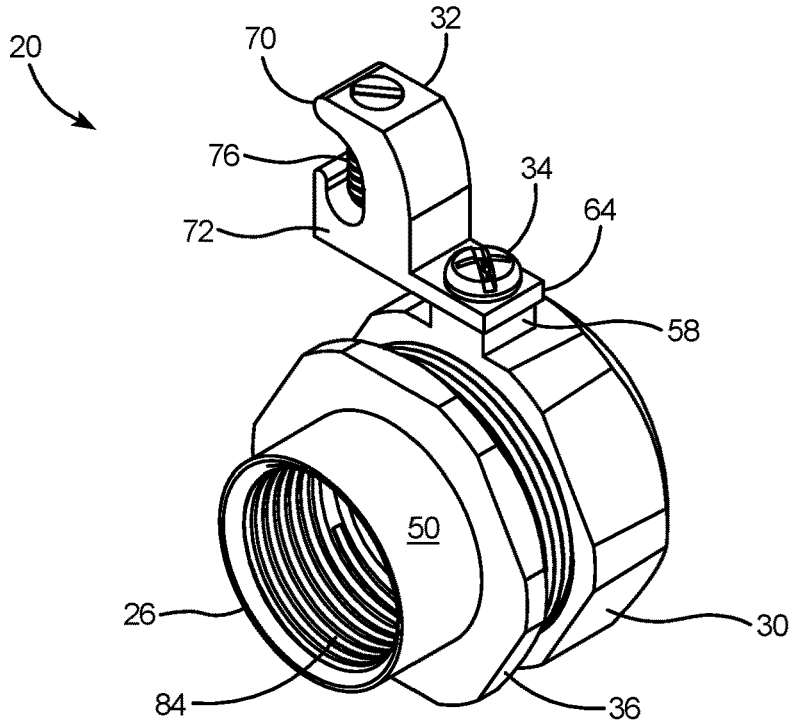
FIG. 7 is an isometric view of the transition fitting from the second end of the fitting.
Figure 8:
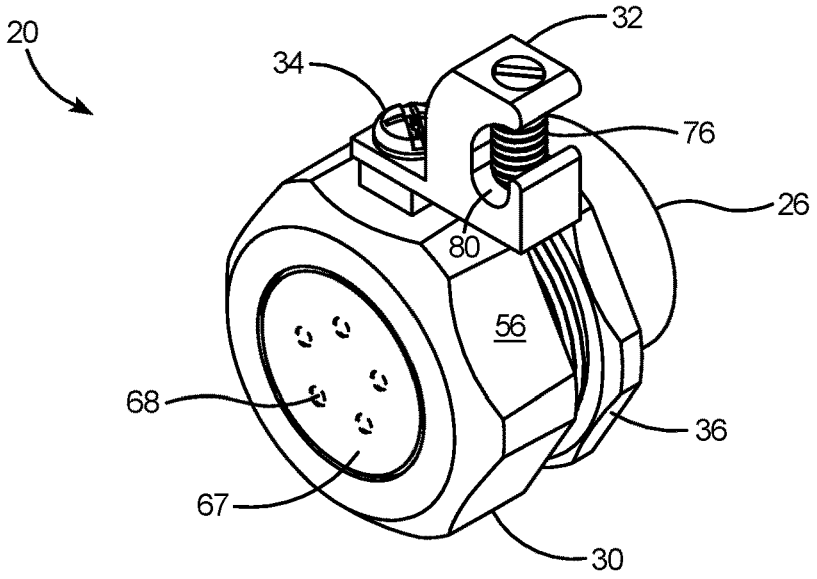
FIG. 8 is an isometric view of the transition fitting from the first end of the fitting.

With reference to FIG. 5, trailing end portion 50 of fitting body 22 includes interior threads 82 that define a socket 84 therein. Socket 84 of trailing end portion 50 is adapted to accept attachment of EMT therein.

Referring to FIG. 1, with the nut 30 disassembled from the transition fitting 20, the bore 40 of fitting body 22 is adapted to accept insertion of grommet 28. Photovoltaic wires (not shown) may then be inserted into one or more of the bores 68 in grommet 28 after which the nut 30 may be threaded onto the leading end portion 46 of the fitting body 22 and tightened to compress the grommet 28 and secure the photovoltaic wires within the transition fitting 20 in a rain-tight fit.

As shown in FIG. 5, bores 68 may be formed partially through the grommet 28 from its trailing end 85 to form a skin 86 over the aperture at the leading face 67. A skin 86 will thus seal each bore 68 at the leading face of the grommet until it is broken by inserting a wire there through. Any unused apertures will thus remain sealed. Fitting body 22 includes a collar 88 that provides a first stop 90 for stopping advancement of the grommet 28 as it is inserted within the bore 40 (see FIG. 1) of the fitting body and a second stop 92 for stopping advancement of an end of EMT (not shown) as it is inserted into the socket 84. The narrowest portion of the bore extending through the fitting body 22 is at the collar 88.

Figure 10:
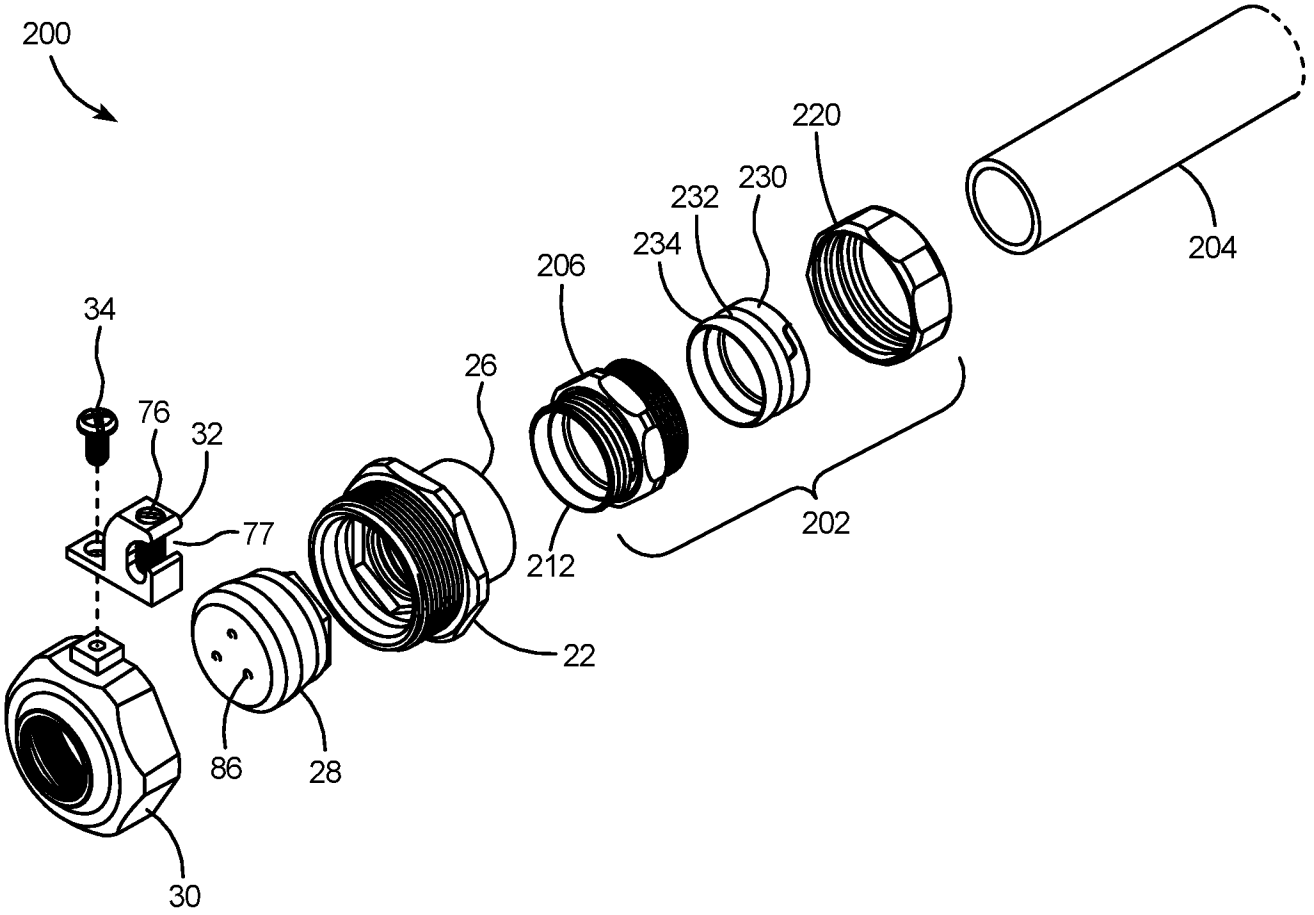
FIG. 10 is an isometric view of a second embodiment of a transition fitting according to the present invention.

With reference to FIG. 10, a second embodiment of the transition fitting 200 for connecting EMT to photovoltaic wires includes a tubular fitting body 22, a grommet 28, a nut 30, a ground lug 32, a fastener 34, and a rain-tight EMT compression fitting 202 for securing electrical metal tubing (EMT) 204 to the trailing end 26 of the fitting body 22.

Figure 9:
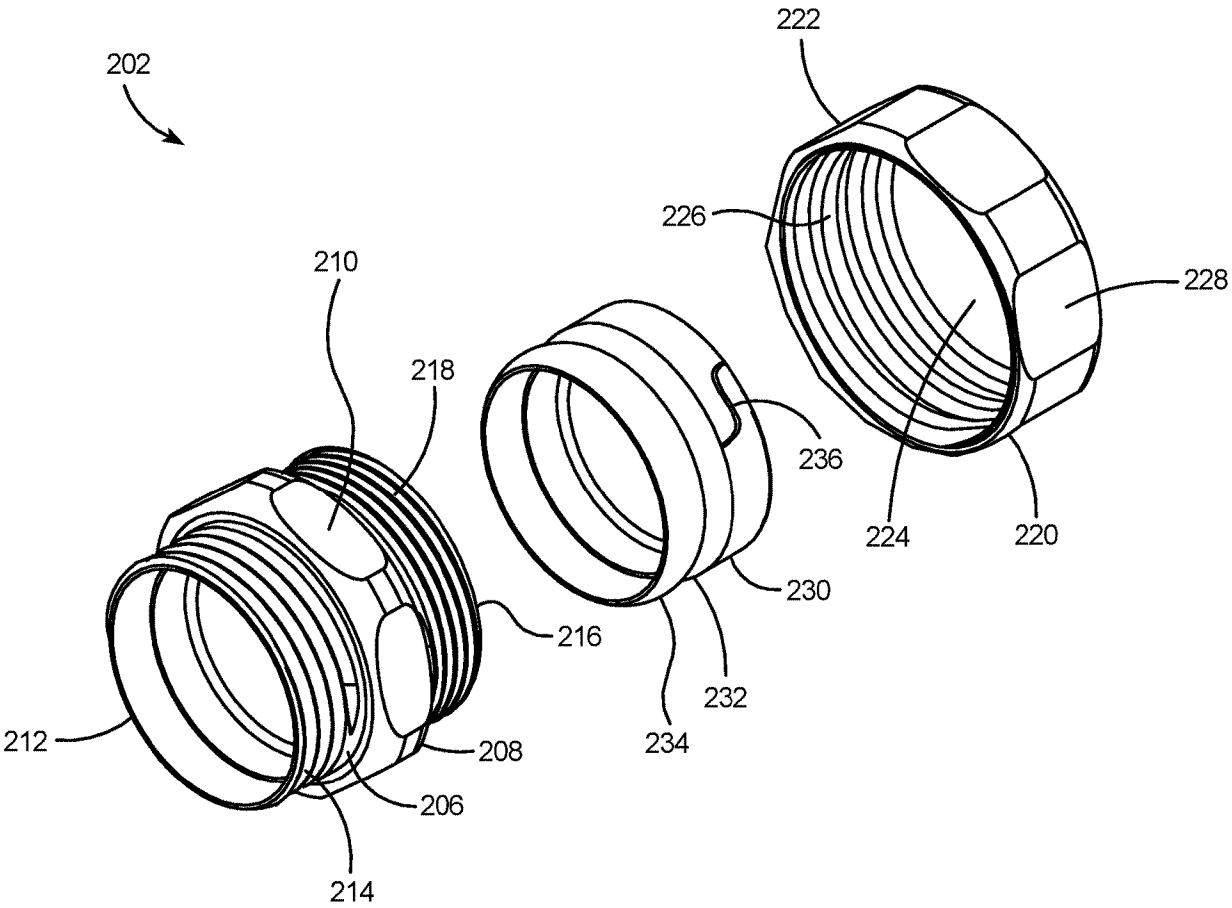
FIG. 9 is an isometric view of a rain-tight EMT compression fitting.

Referring to FIG. 9, the tubular compression fitting 202 includes a connector body 206 having a central flange 208 with one or more flat edges 210 to facilitate engagement by a tool (not shown), a front end 212 with threads 214, and a rear end 216 with external threads 218. The compression fitting 202 further includes a compression nut 220 having an outer periphery 222, an inner bore 224, internal threads 226, and hex edges 228 on the outer periphery 222. The compression nut 220 includes one or more compression rings housed within the inner bore 224, which may include a split ring 230, an intermediate ring 232, and a leading ring 234. Tightening of compression nut 220 on rear end 216 of compression fitting 202 will urge the compression rings 230, 232, and 234 to seal against the outer surface of the EMT 204 (see FIG. 10) and secure it tightly to the transition fitting 200 in a rain-tight fit. Most preferably, the split ring 230 is constructed of metal and includes a split 236 therein, the intermediate ring 232 is constructed of metal, and the leading ring 234 is constructed of plastic, although other constructions are considered within the scope of the invention.

With reference to FIG. 10, the transition fitting 200 is used for connecting EMT 204 to one or more photovoltaic (PV) cables in a rain-tight fit. The one or more PV cables (not shown) may be passed through the nut 30, grommet 28, and fitting body 22 of the transition fitting 200, and through the compression fitting 202 including the connector body 206, compression rings 230, 232, and 234, and compression nut 220, and into the EMT 204. When pushed against the grommet 28 at any of the skins 86, the PV cable breaks the skin 86 and passes through. The skin 86 remains intact at any unused location, thereby maintaining a rain-tight seal at the bore 68 associated with the skin (see FIG. 5).

The transition fitting 200 is typically provided as a loose assembly of the nut 30, grommet 28, and fitting body 22 and ground lug 32 is integral with nut 30 by means of fastener 34. The compression fitting 202 is also typically provided as a loose assembly of the connector body 206, compression rings 230, 232, and 234, and compression nut 220. Thus, after the PV cables have been inserted through the two assemblies 200 and 202, nut 30 can be tightened against fitting body 22, which compresses grommet 28 thereby creating a rain-tight seal in the transition fitting and around all of the inserted PV cables. Likewise, a section of EMT 204 may be inserted within the loosely assembled compression fitting 202 after which the compression nut 220 of compression fitting 202 are tightened together to create a rain-tight seal between the EMT and the compression fitting 202. The front end 212 of connector compression fitting 202 is then threaded into the trailing end 26 of the transition fitting 200 to secure the PV cables (not shown) to the EMT 204 in a rain-tight fit without the use of separate sealant materials. The ground lug 32 provides a means for grounding the transition fitting 200 to the EMT 204. A ground wire (not shown) can be secured to the EMT, by means of a clamp (not shown) or similar connection device and then inserted at its opposing end into the channel 77 of the ground lug 32 and secured thereto by the grounding screw 76.

The fitting body 22, nut 30, connector body 206, and compression nut 220 are most preferably die cast of metal. Grommet 28 is preferably constructed of elastomeric material. Preferably grommet 28 is constructed of natural or synthetic rubber or thermoplastic materials. Most preferably grommet 28 is constructed of SANTOPRENE®, available from ExxonMobil Chemical Company of Houston, Tex.

Referring to FIG. 1, the transition fitting 20 includes gripping means 93 on the grommet 28 to keep it from turning with respect to the fitting body 22 when the grommet and fitting body are joined together. The gripping means 93 includes one or more external facets 94 on the grommet 28 that mate with complementary internal facets 44 of fitting body. On insertion of grommet 28 into bore 40 of fitting body 22, the mating facets of grommet and fitting body create locking engagement of the grommet with respect to the fitting body, after which rotation of grommet 28 with respect to fitting body 22 will be eliminated and tightening of nut 30 will cause compression of the grommet 28 and will result in locking of any inserted wires within the transition fitting 20 in a rain-tight fit.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A transition fitting for securing wires to electrical metal tubing (EMT), comprising:

a fitting body including a leading end, a trailing end, and a bore;

a grommet within said bore of said fitting body, said grommet having a leading face and a trailing end;

a nut with an internally threaded bore;

grounding means for grounding the wires to the EMT and the fitting body;

one or more bores in said trailing end of said grommet; and a skin extending across said one or more bores at said leading face of said grommet.

2. A transition fitting for securing wires to electrical metal tubing (EMT), comprising:

a fitting body including a leading end, a trailing end, and a bore;

a grommet within said bore of said fitting body, said grommet having a leading face and a trailing end;

a nut with an internally threaded bore;

grounding means for grounding the wires to the EMT and the fitting body;

gripping means on said grommet to prevent rotation of said grommet with respect to said fitting body; and said gripping means including an external facet on said trailing end of said grommet and an internal facet on said fitting body, whereby meshing of said internal facet on said fitting body with said external facet on said grommet locks rotation of said grommet with respect to said fitting body.

3. A transition fitting for securing wires to electrical metal tubing (EMT), comprising:

a fitting body including a leading end, a trailing end, and a bore;

a grommet within said bore of said fitting body, said grommet having a leading face and a trailing end;

a nut with an internally threaded bore;

grounding means for grounding the wires to the EMT and the fitting body;

a ground lug on said nut;

a post on said nut of said transition fitting, said post including a bore; and a fastener for securing said ground lug into said bore of said post.

4. The transition fitting of claim 3, further comprising a lug body on said ground lug, said lug body including a top arm, a bottom arm, and a grounding screw.

5. The transition fitting of claim 4, further comprising a channel on said lug body, said channel adapted to receive a ground wire for grounding the wires to the EMT, wherein said ground wire secured to said channel by said grounding screw.

6. The transition fitting of claim 5, further comprising:

a flange on said fitting body; and said fitting body including an externally threaded leading end portion extending from said flange to said leading end of said fitting body for receiving said nut.

7. A transition fitting for securing wires to electrical metal tubing (EMT), comprising:

a fitting body including a leading end, a trailing end, and a bore;

a grommet within said bore of said fitting body, said grommet having a leading face and a trailing end;

a nut with an internally threaded bore;

grounding means for grounding the wires to the EMT and the fitting body;

a trailing end portion on said fitting body; and interior threads on said trailing end portion defining a socket in said trailing end portion, said socket of said trailing end portion adapted to accept attachment of the EMT therein.

8. A transition fitting for securing wires to electrical metal tubing (EMT), comprising:

a fitting body including a leading end, a trailing end, and a bore;

a grommet within said bore of said fitting body, said grommet having a leading face and a trailing end;

a nut with an internally threaded bore;

grounding means for grounding the wires to the EMT and the fitting body; and a compression fitting including a connector body having an inner bore, one or more compression rings within said inner bore, and a compression nut, wherein said connector body adapted to accept said trailing end of said fitting body.

9. The transition fitting of claim 8, wherein said one or more compression rings further comprises:

a split ring, an intermediate ring, and a leading ring; and wherein said connector body further having a central flange with one or more flat edges for facilitating engagement of a tool, wherein tightening of said compression nut, said compression fitting urges said split ring, said intermediate ring and said leading ring to seal against an outer surface of said EMT.

* * * * *